US008425256B2

(12) United States Patent
Aoki et al.

(10) Patent No.: US 8,425,256 B2
(45) Date of Patent: Apr. 23, 2013

(54) CONNECTOR

(75) Inventors: Eiji Aoki, Makinohara (JP); Motoo Nojima, Tokyo (JP); Taro Mizuno, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/379,718

(22) PCT Filed: Apr. 12, 2011

(86) PCT No.: PCT/JP2011/059097

§ 371 (c)(1),
(2), (4) Date: Dec. 21, 2011

(87) PCT Pub. No.: WO2011/129336

PCT Pub. Date: Oct. 20, 2011

(65) Prior Publication Data

US 2012/0094537 A1 Apr. 19, 2012

(30) Foreign Application Priority Data

Apr. 13, 2010 (JP) ..... 2010-092171

(51) Int. Cl.
*H01R 13/648* (2006.01)

(52) U.S. Cl.
USPC ..... 439/620.26; 439/620.32

(58) Field of Classification Search ..... 439/620.29–620.33, 620.26
See application file for complete search history.

(56) References Cited

U.S. PATENT DOCUMENTS 6,030,257 A * 2/2000 Furuya ..... 439/620.26
6,551,141 B2 * 4/2003 Liang ..... 439/620.27
7,118,400 B1 * 10/2006 Lopez et al. ..... 439/170

FOREIGN PATENT DOCUMENTS

JP 44-25087 Y1 10/1969
JP 2004-273381 A 9/2004
JP 2005-310585 A 11/2005

OTHER PUBLICATIONS

International Search Report [PCT/ISA/210], dated May 24, 2011, from the International Searching Authority, issued in counterpart International Application No. PCT/JP2011/059097.
Written Opinion of the International Searching Authority [PCT/ISA/237], dated May 24, 2011, issued in International Application No. PCT/JP2011/059097.

* cited by examiner

*Primary Examiner* — Gary F. Paumen
(74) *Attorney, Agent, or Firm* — Sughrue Mion, PLLC

(57) ABSTRACT

It is an object to provide a connector to which a fuse can be detachably attached and that can reduce components or improve reliability and improve a shield performance. The connector includes first and second bus bars 11 and 21, a fuse 31 that electrically conducts and connects the first and second bus bars 11 and 21 to each other so as to be fused and a housing 41 that accommodates the first and second bus bars 11 and 21 and the fuse 31. The first and second bus bars 21 include tabs 12 and 22 for a device inserted into the device 3 and connected to a circuit in the device 3. The housing 41 has a hood part 43 that covers the peripheries of the tabs 12 and 22 for the device and is fitted to a connector attaching hole 6 of the device 3 and the fuse 31 is attached to an accommodating space 45 in the hood part 43.

3 Claims, 12 Drawing Sheets

CONNECTOR

TECHNICAL FIELD

The present invention relates to a connector that connects an electric wire to a device mounted on, for instance, a vehicle.

BACKGROUND ART

FIG. 9 shows a usual example of a connector that connects a shielded electric wire to a device mounted on a vehicle.

The connector 101 shown herein is a connector that connects a shielded electric wire to a terminal not shown in the drawing in a device 110 mounted on a vehicle and is disclosed in below-described patent literature 1.

The connector 101 includes two bus bars 103 arranged in directions orthogonal to each other on a sheet surface shown in the drawing, a fuse 105 that electrically conducts and connects the two bus bars 103 to each other so as to be fused and a housing 107 made of a resin that accommodates the bus bars 103 and the fuse 105.

The bus bars 103 are products manufactured by a press work of a metal plate and includes a tab 103*a* for the device inserted into the device 110 and connected to a circuit in the device 110 and a tab 103*b* for an external electric wire connected to an external shielded electric wire not shown in the drawing.

The fuse 105 has one end screwed to the one bus bar 103 and the other end screwed to the other bus bar 103 to electrically conduct the two bus bars 103 to each other so as to be fused.

In the housing 107, the bars 103 to be accommodated are fixed by a resin mold. In the housing 107, an upper part located in an external part of the device 110 can be opened and closed by an opening and closing cover 108. In FIG. 9, the opening and closing cover 108 is opened. Under a state that the opening and closing cover 108 is opened, an upper side of a fuse accommodating part 107*a* in the housing 107 is opened to an outer part and the fuse 105 can be attached or detached from the opened part.

To the housing 107, a shield cover 109 is attached which covers an outer periphery of the housing 107 to electromagnetically shield inner and outer parts of the housing 107.

As described above, in the connector 101 disclosed in the patent literature 1, when the opening and closing cover 108 which covers the upper part of the housing 107 located in the external part of the device 110 is opened, the fuse accommodating part 107*a* is opened to the outer part so that the fuse 105 may be attached and detached.

FIG. 10 to FIG. 12 show another usual example of a connector which connects a shielded electric wire to a device mounted on a vehicle. FIG. 10 is a perspective view of an assembled state of the connector as another usual example. FIG. 11 is a perspective view of a state that an opening and closing cover of the connector as another usual example is opened so that a fuse in a housing may be detachably attached. FIG. 12 is a perspective view of a state that the fuse is taken put from the housing.

The connector 121 as another usual example also serves to connect the shielded electric wire to a terminal in the device mounted on the vehicle and includes, similarly to the connector 101 shown in FIG. 9, two bus bars 123, a fuse 125 that electrically conducts and connects the two bus bars 123 to each other so as to be fused and a housing 127 made of a resin that accommodates the bus bars 123 and the fuse 125.

The bus bars 123 are products manufactured by a press work of a metal plate as shown in FIG. 11 and includes tabs 123*a* for the device inserted into the device mounted on the vehicle not shown in the drawing and connected to a circuit in the device and tabs for external electric wires not shown in the drawing and connected to external shielded electric wires 141

The fuse 125 has one end screwed to the one bus bar 123 and the other end screwed to the other bus bar 123 to electrically conduct the two bus bars 123 to each other so as to be fused. Reference numeral 133 in FIG. 12 designates a nut used for screwing the fuse 125.

In the housing 127, a device attaching part 131 to be attached to the device not shown in the drawing is extended in one side of an upper part. In the housing 127, similarly to the connector 101 disclosed in the patent literature 1, an upper part located in an external part of the device can be opened and closed by an opening and closing cover 128. In FIG. 11, the opening and closing cover 128 is opened. Under a state that the opening and closing cover 128 is opened, an upper side of a fuse accommodating part 127*a* in the housing 127 is opened to an outer part and the fuse 125 can be attached or detached from the opened part as shown in FIG. 12.

Namely, as in the case of the connector 101 disclosed in the patent literature 1, in the connector 121 shown in FIG. 10 to FIG. 12, when the opening and closing cover 128 which covers the upper part of the housing 127 located in the external part of the device is opened, the fuse accommodating part 127*a* is opened to the outer part so that the fuse 125 may be attached and detached.

LITERATURE OF RELATED ART

Patent Literature

Patent Literature 1: JP-A-2004-273381

SUMMARY OF THE INVENTION

Problems that the Invention is to Solve

However, as described above, the connectors 101 and 121 respectively shown in the above-described patent literature 1 or FIG. 10 to FIG. 12 have structures that the opening and closing covers 108 and 128 of the upper parts of the housings 107 and 127 located in the external parts of the device are opened to attach or detach the fuse 105 and 125. Accordingly, since the opening and closing covers 108 and 128 are provided in the housings 107 and 127, fixing units such as screws for fastening the opening and closing covers 108 and 128 to the housings or packing that ensures the water proof property of the opening parts by the opening and closing covers 108 and 128 are necessary. Thus, a problem arises that parts forming the connectors are increased.

Further, there is a fear that reliability for a water proof property may be possibly injured due to a forgetfulness to fasten the opening and closing covers 108 and 128 after an exchanging work of the fuses.

Further, when the shield covers are attached which cover the outer peripheries of the housings, since the forms of the shield covers are limited so that the shield covers are not obstacles to open and close the opening and closing covers 108 and 128. Thus, a problem arises that a shield performance is hardly improved.

Thus, it is an object of the present invention to solve the above-described problems and to provide a connector to which a fuse can be detachably attached and that can reduce components or improve reliability and improve a shield performance.

Means for Solving the Problems

The above-described object of the present invention can be achieved by below-described structures.

(1) A connector including a first bus bar;

a second bus bar separate from the first bus bar;

a fuse having one end screwed to the first bus bar and the other end screwed to the second bus bar to electrically conduct and connect the first bus bar and the second bus bar to each other so as to be fused; and a housing that accommodates the first bus bar, the second bus bar and the fuse, wherein the first bus bar and the second bus bar include a tab for a device inserted into the device and connected to a circuit in the device and a tab for an external electric wire connected to the external electric wire, the housing has a hood part that covers the peripheries of the tabs for the device and is fitted to a connector attaching hole of the device and the fuse is attached to an accommodating space in the hood part opened to the device.

(2) A connector according to the above-described (1), wherein a packing is provided in an outer periphery of the hood part to liquid-tightly seal a part between the hood part and the connector attaching hole.

(3) A connector according to the above-described (1) or (2), wherein the electric wires connected to the tabs for the external electric wires are shielded electric wires, and to the housing, a shield cover is attached that covers the outer periphery of the housing to electromagnetically shield inner and outer parts of the housing.

According to the structure of the above-described (1), the accommodating space in the connector that accommodates the fuse is located in the hood part of the housing which is fitted to the connector attaching hole of the device. Accordingly, when the housing is detached from the device, the hood part is exposed so that the fuse may be attached or detached.

Further, the accommodating space as an attaching part of the fuse is not covered with an opening and closing cover. Thus, as compared with the usual connector in which the attaching part of the fuse can be opened and closed by the opening and closing cover, all of the opening and closing cover, the packing or fastening units for fixing the opening and closing cover to the housing can be omitted. Accordingly, components in the connector can be extremely reduced.

Further, since the opening and closing cover is not provided, there is no fear that reliability for a water proof property may be possibly injured due to a forgetfulness to fasten the opening and closing cover and the reliability in the connector can be improved.

According to the structure of the above-described (2), since the part between the hood part of the housing and the connector attaching hole of the device is waterproofed by the packing, water-drops can be prevented from entering the device from the part between the hood part and the connector attaching hole to improve a water proof property to the fuse accommodated in the hood part located in the device 3.

According to the structure of the above-described (3), since the housing has a simple structure that does not include the opening and closing cover for opening and closing the attaching part of the fuse, as compared with the usual connector having the opening and closing cover, the shield cover that electromagnetically shields the inner and outer parts of the housing easily covers the outer periphery of the housing so that a shield performance may be improved.

MODE FOR CARRYING OUT THE INVENTION

Figure 1:
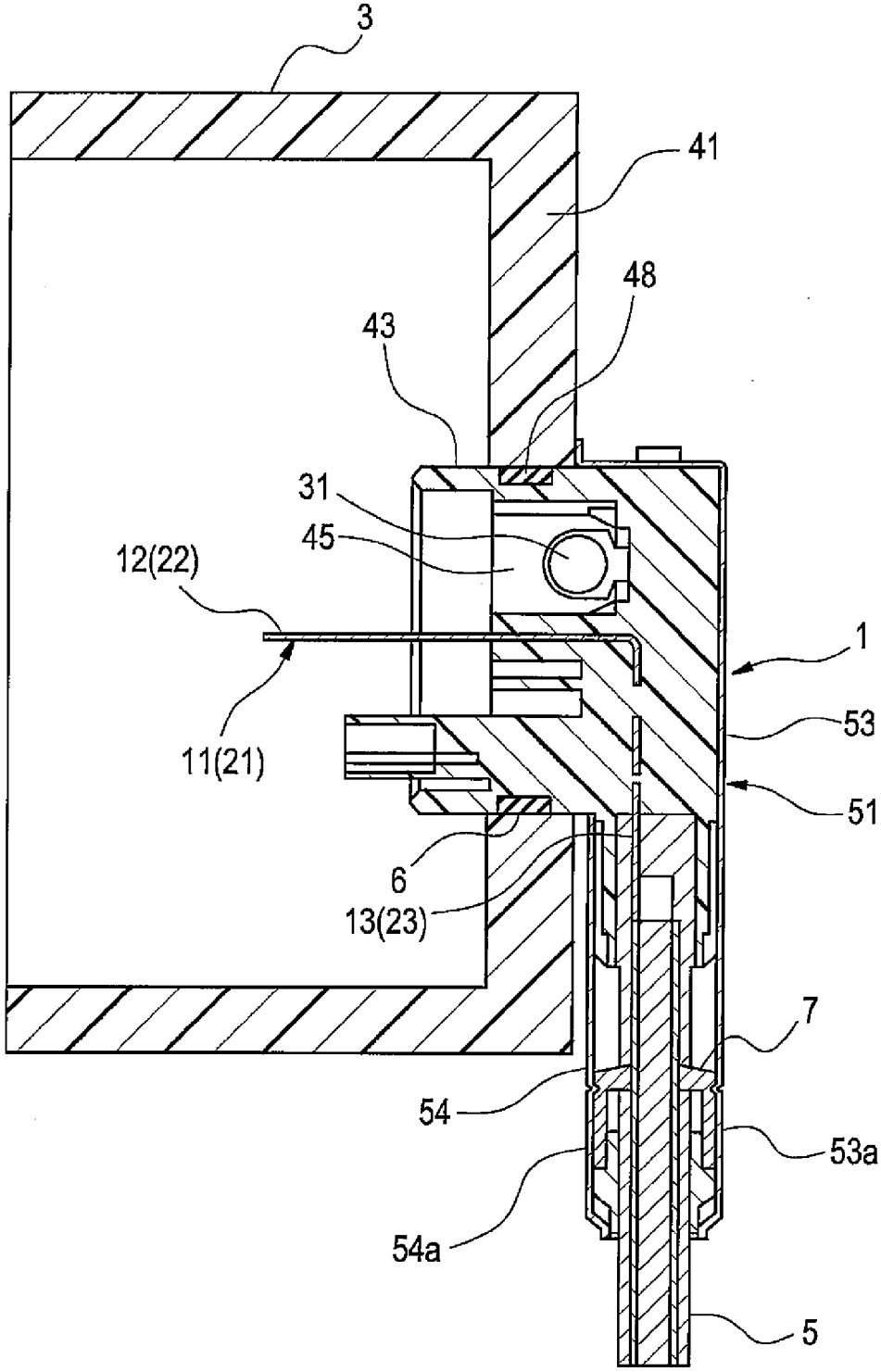
FIG. 1 is a longitudinally sectional view showing a state that a connector of one exemplary embodiment according to the present invention is attached to a device.

Now, a preferably suitable exemplary embodiment of a connector according to the present invention will be described below in detail by referring to the drawings.

Figure 2:
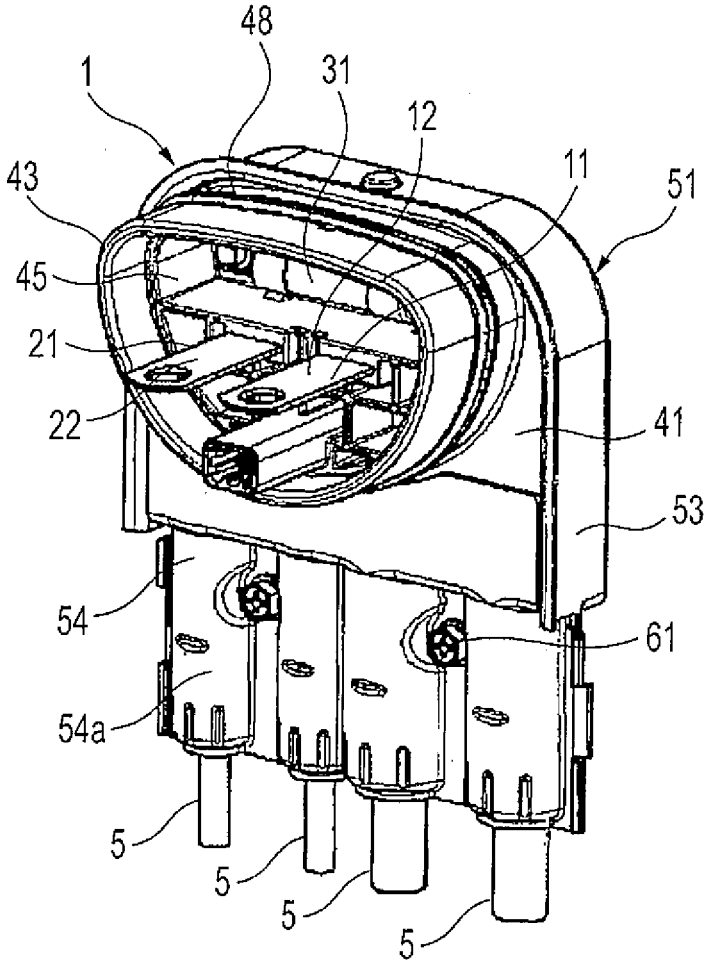
FIG. 2 is perspective view of the connector shown in FIG. 1 as a single member.
Figure 3:
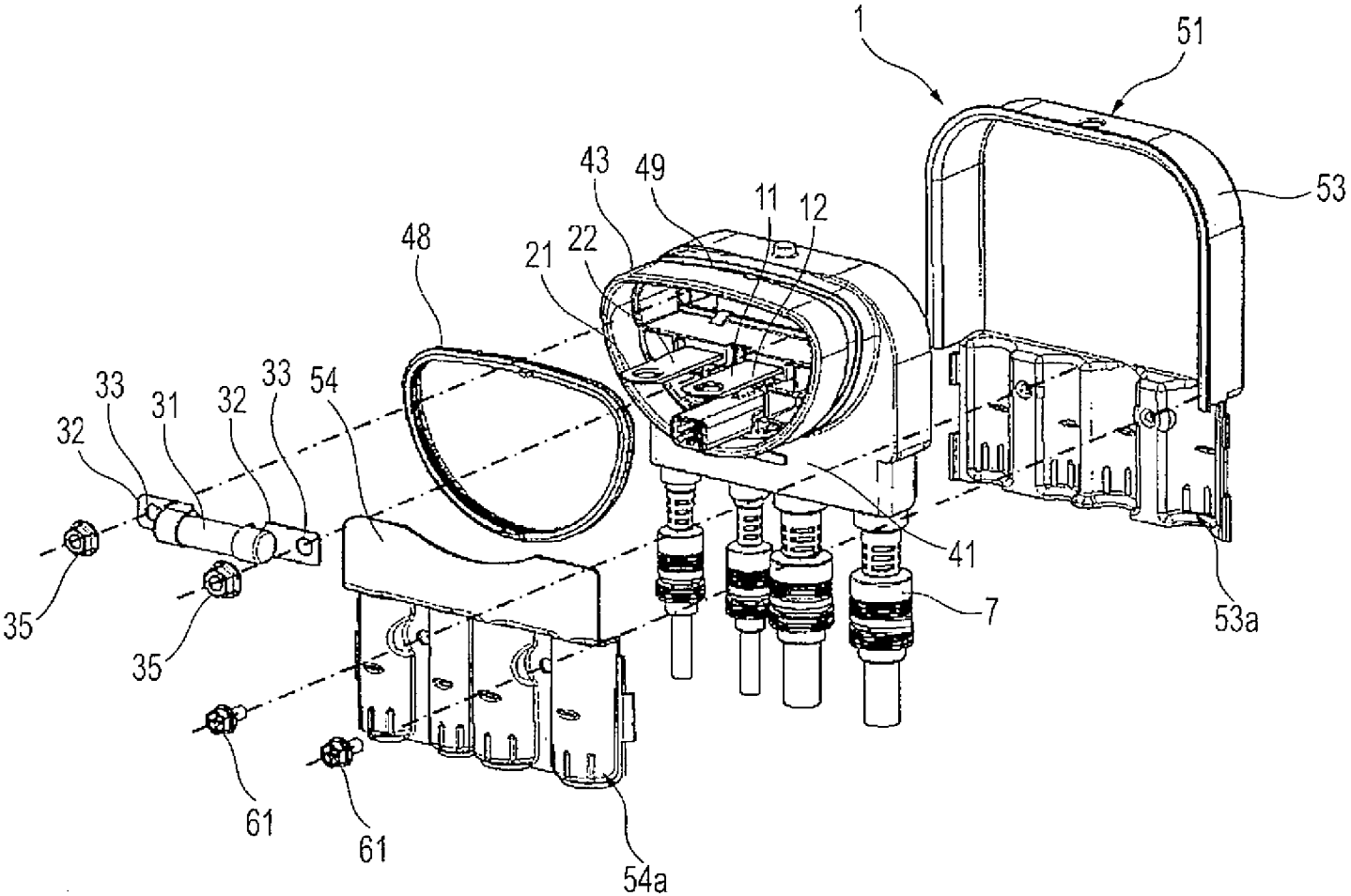
FIG. 3 is an exploded perspective view of the connector shown in FIG. 2.
Figure 4:
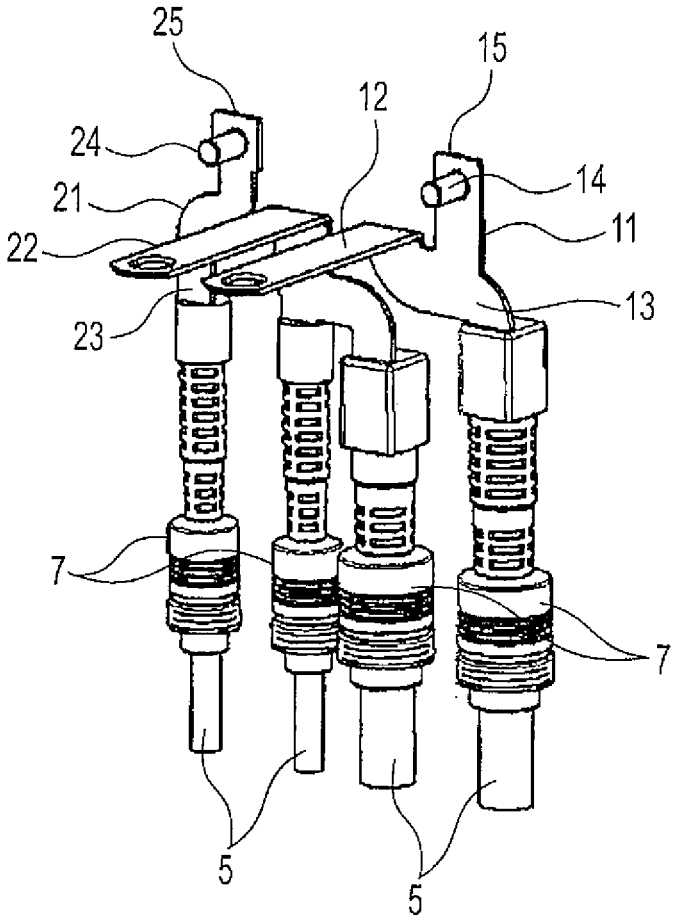
FIG. 4 is a perspective view of a first bus bar and a second bus bar accommodated in the connector shown in FIG. 2.
Figure 5:
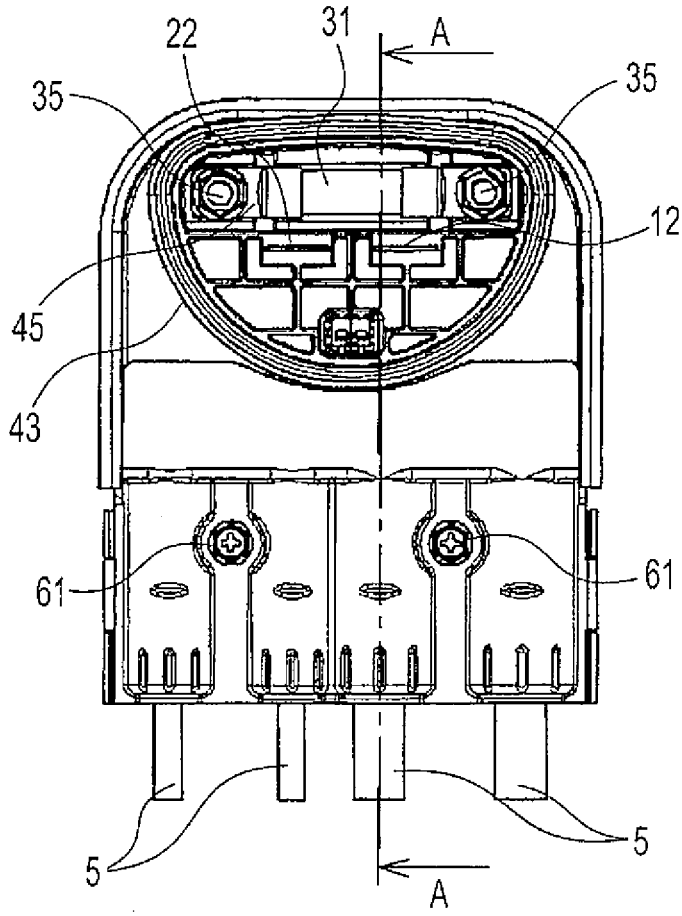
FIG. 5 is a front view of the connector shown in FIG. 2.
Figure 6:
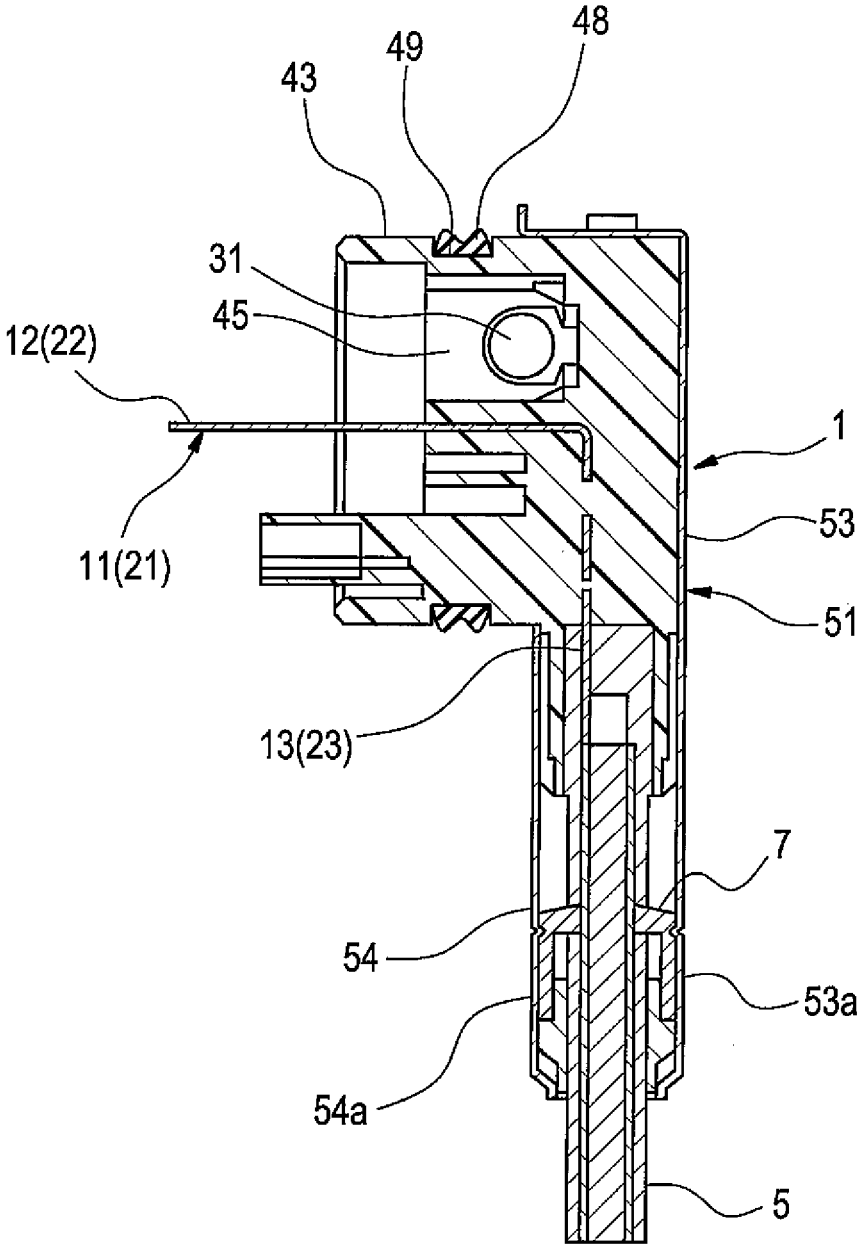
FIG. 6 is a sectional view taken along a line A-A in FIG. 5.

FIG. 1 to FIG. 6 show one exemplary embodiment of the connector according to the present invention. FIG. 1 is a longitudinally sectional view showing a state that the connector of one exemplary embodiment is attached to a device. FIG. 2 is perspective view of the connector shown in FIG. 1 as a single member. FIG. 3 is an exploded perspective view of the connector shown in FIG. 2. FIG. 4 is a perspective view of a first bus bar and a second bus bar accommodated in the connector shown in FIG. 2. FIG. 5 is a front view of the connector shown in FIG. 2. FIG. 6 is a sectional view taken along a line A-A in FIG. 5.

The connector 1 of the one exemplary embodiment is what is called a shield connector that connects a shielded electric wire 5 to a device 3 mounted on a vehicle and includes a first bus bar 11, a second bus bar 21 separate from the first bus bar 11, a fuse 31 having one end screwed to the first bus bar 11 and the other end screwed to the second bus bar 21 to electrically conduct and connect the first bus bar 11 to the second bus bar 21 so as to be fused and a housing 41 that accommodates the first bus bar 11 and the second bus bar 21 and a shield cover 51 that covers an outer periphery of the housing 41.

The first bus bar 11 and the second bus bar 21 are formed with a thin plate and includes, as shown in FIG. 1 and FIG. 4, tabs 12 and 22 for the device inserted into the device 3 and connected to a circuit in the device 3 and tabs 13 and 23 for external electric wires connected to shielded electric wires 5 as the external electric wires and stud bolts 14 and 24 for screwing the fuse 31.

As shown in FIG. 1 and FIG. 4, shield terminals 7 are fitted and attached to shield layers (braided wires) of the shielded electric wires 5 connected to the tabs 13 and 23 for the external electric wires.

As shown in FIG. 4, the stud bolts 14 and 24 are planted on lug parts 15 and 25 for connecting the fuse which are respectively formed integrally with the bus bars 11 and 21.

As shown in FIG. 3, in the fuse 31, bolt insert holes 33 into which the stud bolts 14 and 24 are inserted are formed in connecting terminal parts 32 at both ends. The connecting terminal parts 32 at both the ends of the fuse 31 are respectively screwed to the lug parts 15 and 25 of the bus bars 11 and 21 by fastening nuts 35 screwed to the stud bolts 14 and 24. When the connecting terminal parts 32 at both the ends are respectively screwed to the bus bars 11 and 21, the fuse 31 electrically conducts and connects the first bus bar 11 and the second bus bar 21 to each other so as to be fused.

The housing 41 is made of a resin. The first bus bar 21 and the second bus bar 21 accommodated in the housing 41 are fixed to the housing 41 by an insert molding when the housing 41 is formed or a resin mold. The housing 41 in the present exemplary embodiment is provided with a tubular hood part 43 that covers peripheries of the tabs 12 and 22 for the device and is fitted to a connector attaching hole 6 of the device 3.

Further, in the housing 41 of the present exemplary embodiment, as shown in FIG. 5 and FIG. 6, the fuse 31 is attached to an accommodating space 45 in the hood part 43 opened to the device 3.

Namely, the forms and dimensions of the bas bars 11 and 21 are respectively set so that the fuse 31 is screwed to the bus bars 11 and 21 respectively in the accommodating space 45.

Further, in the case of the housing 41 of the present exemplary embodiment, as shown in FIG. 3, a seal groove 49 to which a ring shaped packing 48 is attached is formed in an outer periphery of the hood part 43.

When the hood part 43 is fitted to the connector attaching hole 6 as shown in FIG. 1, the packing 48 attached to the hood part 43 is closely fitted to the connector attaching hole 6 to liquid-tightly seal a part between the hood part 43 and the connector attaching hole 6.

As shown in FIG. 3, the shield cover 51 includes a first shield shell 53 that covers the housing 41 from an opposite side from the device 3 and a second shield shell 54 that covers the housing 41 from the device 3 side. The first shield shell 53 and the second shield shell 54 are attached to the housing 41 so as to sandwich the housing 41 between them to cover substantially the outer periphery of the housing 41 except the hood part 43 so that inner and outer parts of the housing 41 are electromagnetically shielded. Under a state that the first shield shell 53 and the second shield shell 54 hold the housing 41 between them as shown in FIG. 3 and FIG. 5, the first shield shell 53 and the second shield shell 54 are connected to each other by fastening bolts 61.

Further, the first shield shell 53 and the second shield shell 54 include, as shown in FIG. 1 and FIG. 3, terminal contact parts 53*a* and 54*a* that come into close contact with outer peripheries of the shield terminals 7 so that the first shield shell 53 and the second shield shell 54 are electrically conducted and connected to the shield layers of the shielded electric wires 5.

Figure 7:
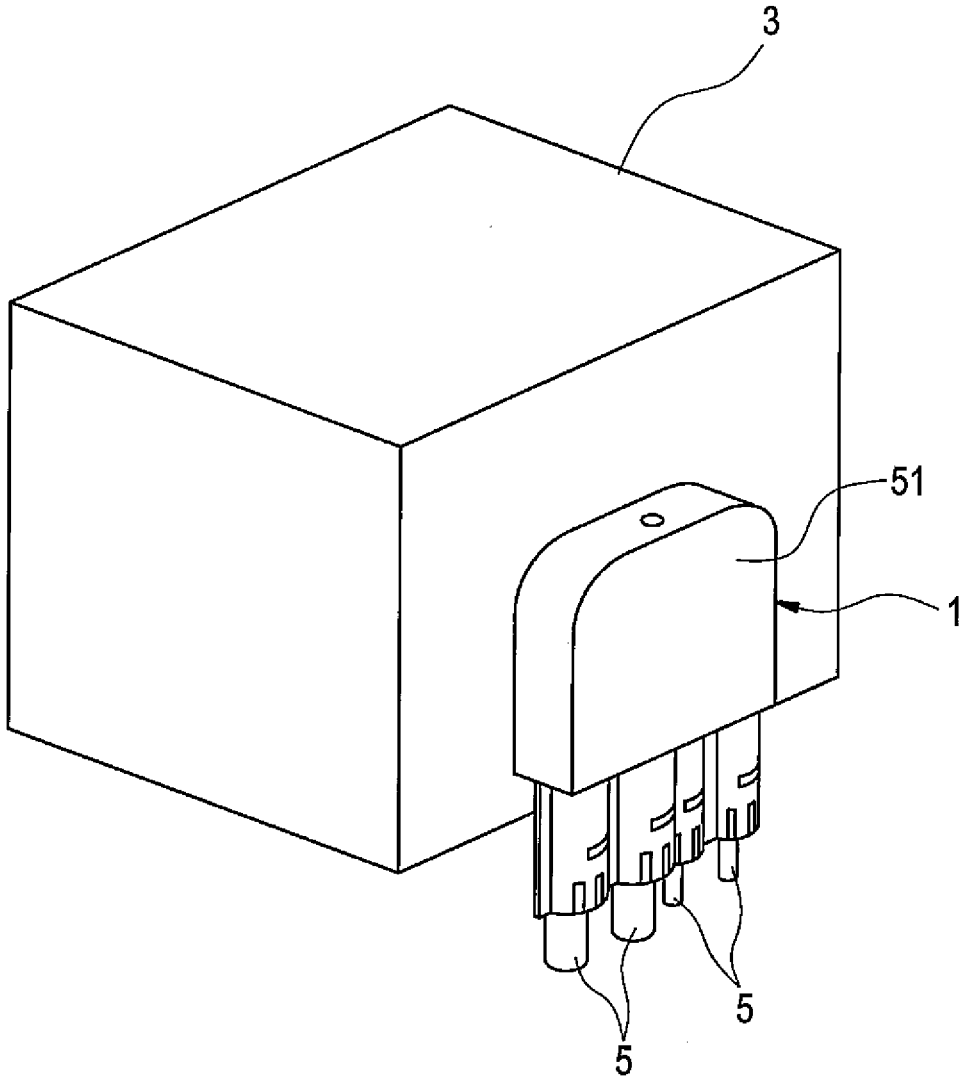
FIG. 7 is a perspective view showing a state that the connector shown in FIG. 1 is attached to the device.
Figure 8:
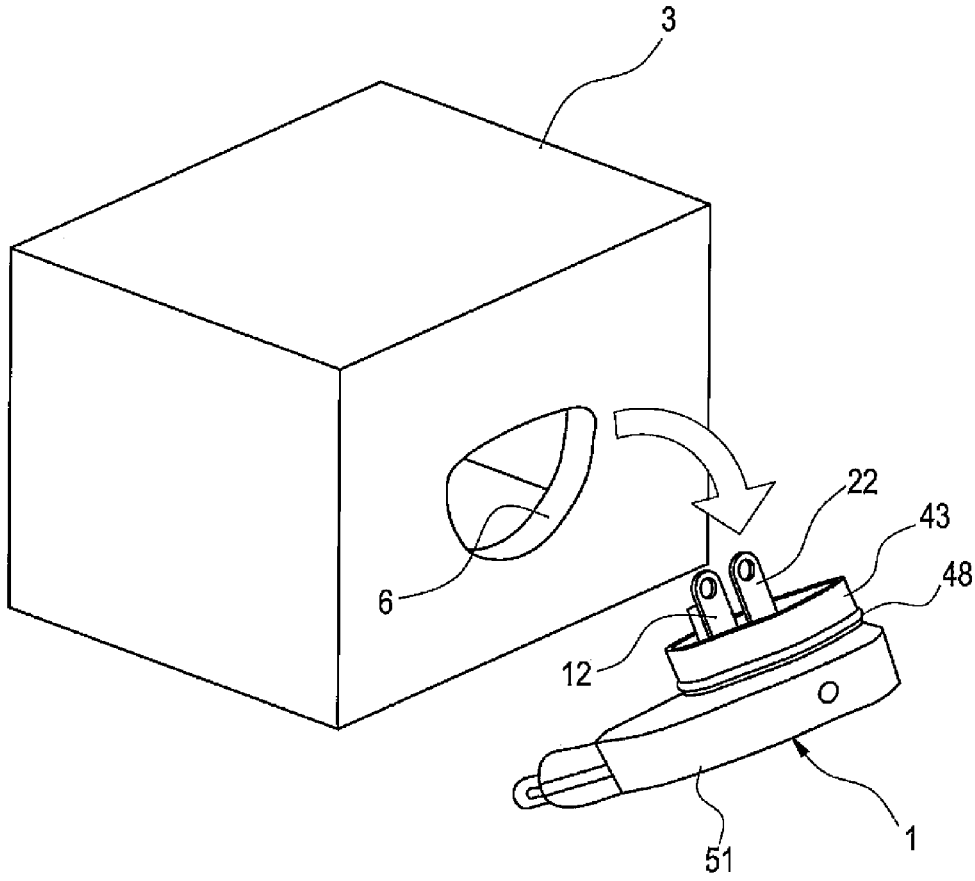
FIG. 8 is a perspective view showing a state that the connector is detached from the device.
Figure 9:
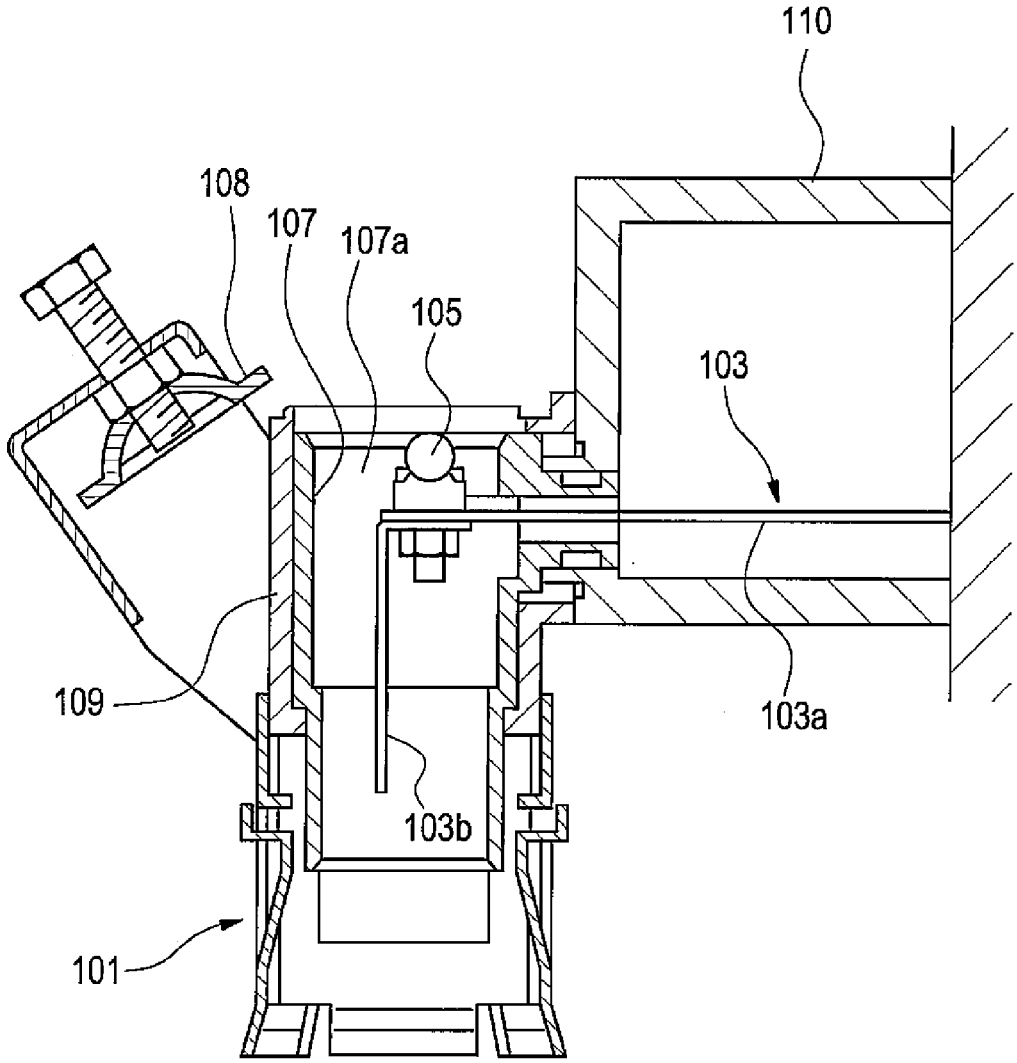
FIG. 9 is a longitudinally sectional view showing a state that a usual connector is attached to a device.
Figure 10:
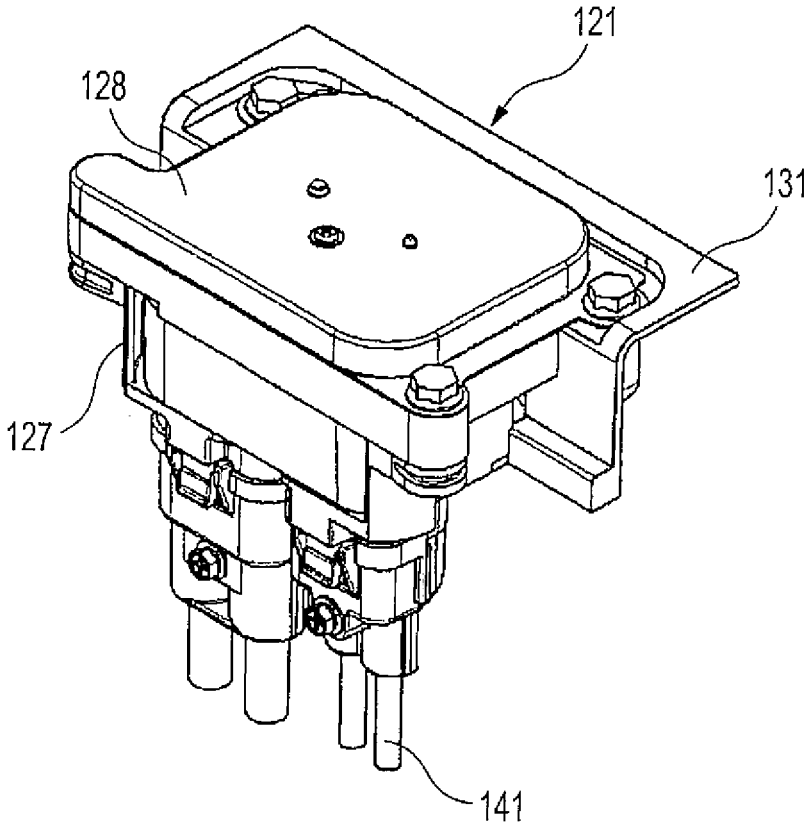
FIG. 10 is a perspective view showing an assembled state of another usual connector.
Figure 11:
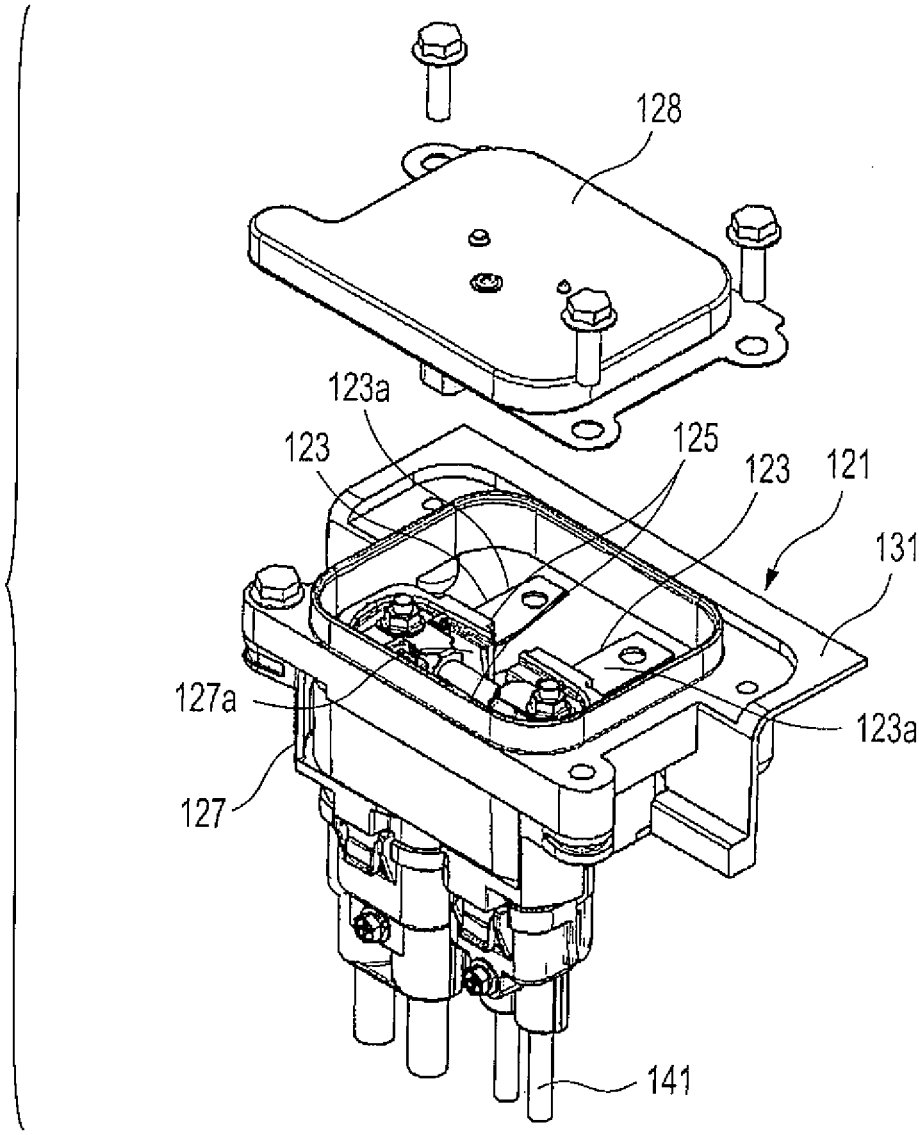
FIG. 11 is a perspective view showing a state that an opening and closing cover of the connector shown in FIG. 10 is detached.
Figure 12:
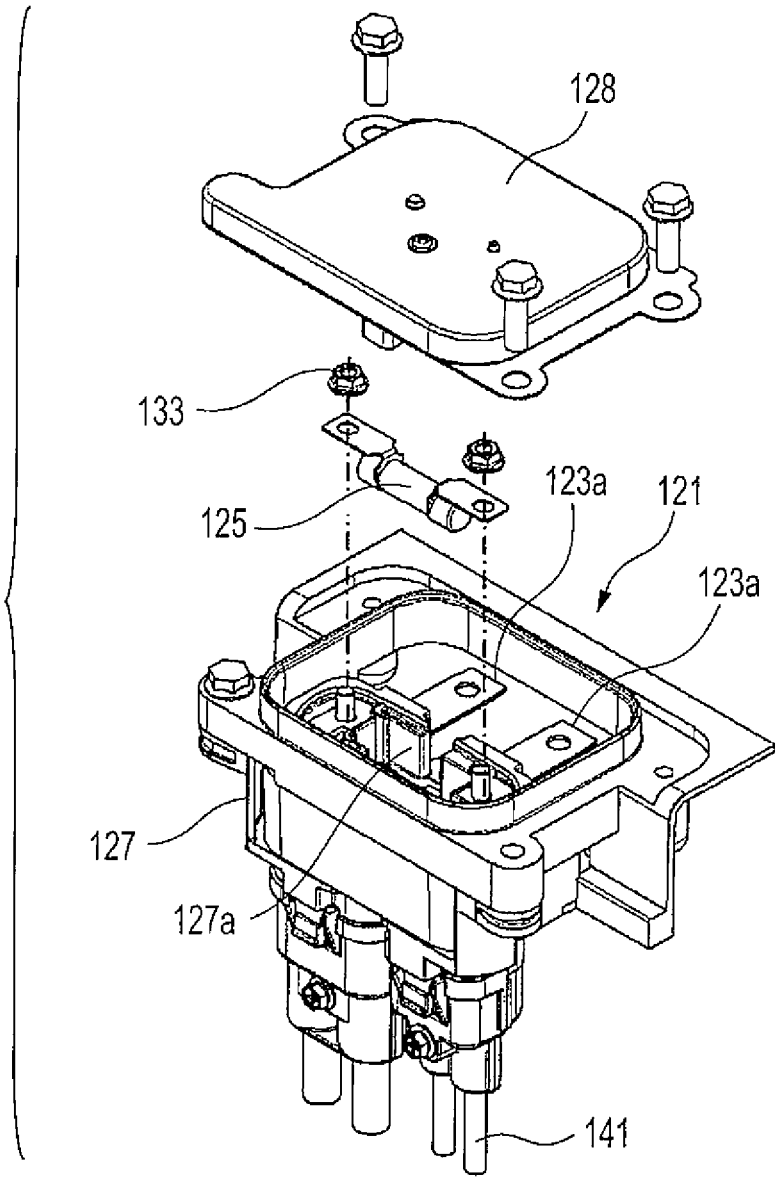
FIG. 12 is a perspective view showing a state that a fuse of the connector shown in FIG. 11 is detached.

As shown in FIG. 1 and FIG. 7, when the hood part 43 is fitted to the connector attaching hole 6 of the device 3, the above-described connector 1 is attached to the device 3. Further, when the connector 1 is detached from the device 3 as shown in FIG. 8, the fuse 31 in the hood part 43 can be attached or detached.

In the connector 1 of the one exemplary embodiment as described above, the accommodating space 45 in the connector 1 that accommodates the fuse 31 is located in the hood part 43 of the housing 41 which is fitted to the connector attaching hole 6 of the device 3. Accordingly, as shown in FIG. 8, when the housing 41 is detached from the device 3, the hood part 43 is exposed so that the fuse 31 may be attached or detached.

Further, the accommodating space 45 as an attaching part of the fuse 31 is not covered with an opening and closing cover. Thus, as compared with the usual connector in which the attaching part of the fuse can be opened and closed by the opening and closing cover, all of the opening and closing cover, the packing or fastening units for fixing the opening and closing cover to the housing can be omitted. Accordingly, components in the connector 1 can be extremely reduced.

Further, since the opening and closing cover is not provided, there is no fear that reliability for a water proof property may be possibly injured due to a forgetfulness to fasten the opening and closing cover and the reliability in the connector 1 can be improved.

Further, in the connector 1 of the above-described exemplary embodiment, since the part between the hood part 43 of the housing 41 and the connector attaching hole 6 of the device 3 is waterproofed by the packing 48, water-drops can be prevented from entering the device 3 from the part between the hood part 43 and the connector attaching hole 6 to improve a water proof property to the fuse 31 accommodated in the hood part 43 located in the device 3.

Further, in the connector 1 of the above-described exemplary embodiment, since the housing 41 has a simple structure that does not include the opening and closing cover for opening and closing the accommodating space 45 as the attaching part of the fuse 31, as compared with the usual connector having the opening and closing cover, the shield cover 51 that electromagnetically shields the inner and outer parts of the housing 41 easily covers the outer periphery of the housing 41 so that a shield performance may be improved.

The connector of the present invention is not limited to the above-described exemplary embodiment, and suitable deformations and improvements may be made. Further, forms, dimensions, configurations, numbers and arranged positions of the hood part or the bus bars respectively exemplified in the above-described exemplary embodiment which can achieve the object of the present invention may be arbitrarily used and are not limited to the above-described exemplary embodiment.

The present invention is described in detail by referring to the specific exemplary embodiment, however, it is to be understood to a person with ordinary skill in the art that various changes or modifications may be made without departing from the spirit and scope of the present invention.

This application is based on Japanese Patent Application (JPA No. 2010-092171) filed on Apr. 13, 2010 and contents thereof are incorporated herein as a reference.

INDUSTRIAL APPLICABILITY

In the connector of the present invention, the accommodating space in the connector that accommodates the fuse is located in the hood part of the housing which is fitted to the connector attaching hole of the device. Accordingly, when the housing is detached from the device, the hood part is exposed so that the fuse may be attached or detached.

Further, the attaching part of the fuse is not covered with an opening and closing cover. Thus, as compared with the usual connector in which the attaching part of the fuse can be opened and closed by the opening and closing cover, all of the opening and closing cover, the packing or fastening units for fixing the opening and closing cover to the housing can be omitted. Accordingly, components in the connector can be extremely reduced.

Further, since the opening and closing cover is not provided, there is no fear that reliability for a water proof property may be possibly injured due to a forgetfulness to fasten the opening and closing cover and the reliability in the connector can be improved.

DESCRIPTION OF REFERENCE NUMERALS AND SIGNS

1 . . . connector (shield connector) 3 . . . device 6 . . . connector attaching hole 11 . . . first bus bar 12 . . . tab for device 21 . . . second bus bar 22 . . . tab for device 31 . . . fuse 41 . . . housing 43 . . . hood part 45 . . . accommodating space 48 . . . packing 51 . . . shield cover 53 . . . first shield shell 54 . . . second shield shell

The invention claimed is:

1. A connector including:

a first bus bar;

a second bus bar separate from the first bus bar;

a fuse having one end screwed to the first bus bar and the other end screwed to the second bus bar to electrically conduct and connect the first bus bar and the second bus bar to each other so as to be fused; and a housing that accommodates the first bus bar, the second bus bar and the fuse, wherein the first bus bar and the second bus bar include a tab for a device inserted into the device and connected to a circuit in the device and a tab for an external electric wire connected to the external electric wire, the housing has a hood part that covers a periphery of the tab for the device and is fitted to a connector attaching hole of the device and the fuse is attached to an accommodating space in the hood part opened to the device.

2. The connector according to claim 1, wherein a packing is provided in an outer periphery of the hood part to liquid-tightly seal a part between the hood part and the connector attaching hole.

3. The connector according to claim 1, wherein the electric wire connected to the tab for the external electric wire is a shielded electric wire and a shield cover that covers the outer periphery of the housing to electromagnetically shield inner and outer parts of the housing is attached to the housing.

* * * * *